United States Patent [19]

Clay

[11] 3,970,213

[45] July 20, 1976

[54] QUICK OPENING/CLOSING COMPRESSION LATCH

[76] Inventor: Charles L. Clay, 118 Third Ave., Fort Walton Beach, Fla. 32548

[22] Filed: Sept. 29, 1975

[21] Appl. No.: 617,776

[52] U.S. Cl. ..... 220/324; 292/113; 292/DIG. 49

[51] Int. Cl.[2] ..... B65D 45/16; E05C 19/12

[58] Field of Search ..... 220/324; 16/80, 111 R, 16/112; 24/248 D; 292/DIG. 49, 113

[56] References Cited

UNITED STATES PATENTS 2,584,500 2/1952 Riordan ..... 220/324 X 3,170,214 2/1965 Cochrane ..... 24/248 D X

*Primary Examiner*—William Price
*Assistant Examiner*—Steven M. Pollard
*Attorney, Agent, or Firm*—Joseph E. Rusz; Arsen Tashjian

[57] ABSTRACT

A toggle type adjustable latch mechanism which distributes the load to two attachment points on the wall of one part of a two-part container. Both overcenter and fulcrum principles are used to apply closure pressure and the latch itself lies within the envelope of the container in the closed position thereby preventing damage to the latch during handling and empty shipment.

4 Claims, 2 Drawing Figures

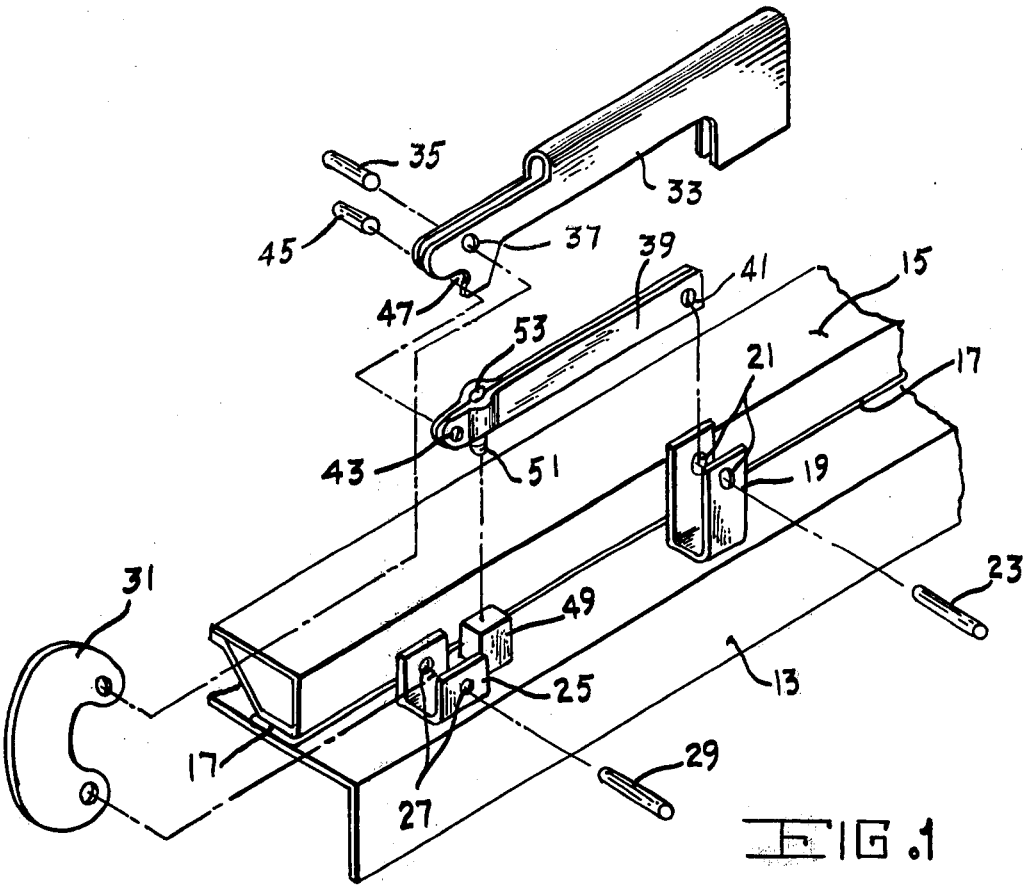
FIG. 1
FIG. 2
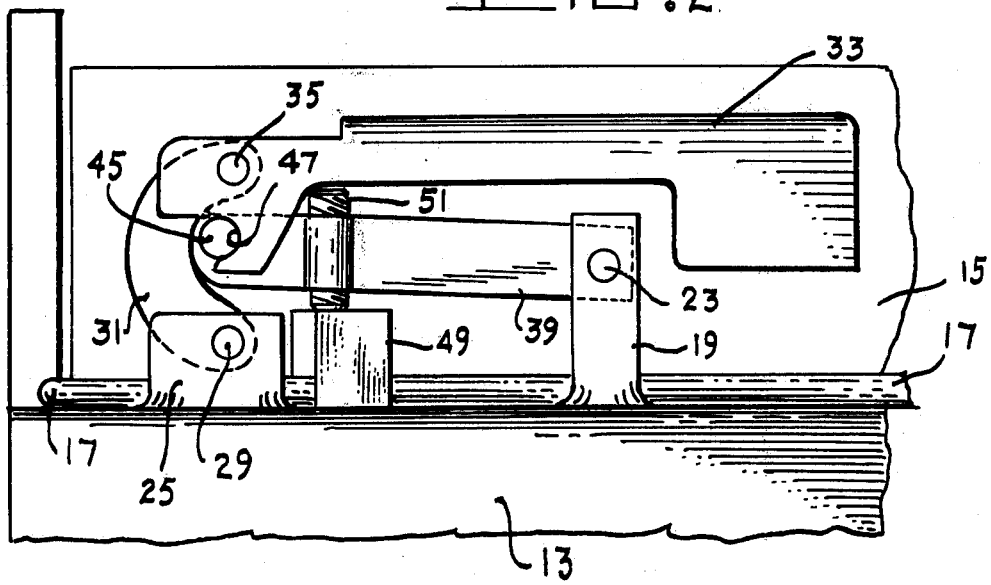

QUICK OPENING/CLOSING COMPRESSION LATCH

STATEMENT OF GOVERNMENT INTEREST

The invention described herein may be manufactured and used by or for the Government for governmental purposes without the payment of any royalty thereon.

BACKGROUND OF THE INVENTION

This invention relates to a new type compression latch for closing containers and, more particularly, the invention is concerned with providing a latch for use on a munitions shipping container wherein the closure pressure is applied by the use of both overcenter and fulcrum principles without the need for tools and the latch itself is totally within the envelope of the container.

Heretofore, the common practice in designing latches for munition containers has been to provide either one of two types of closure systems. The first and most common system is one wherein large exposed surfaces function as handles for applying the loads required to apply the closure pressure. These handles usually extend beyond the envelope of the container and, therefore, are easily damaged by blows or by accidental hooking of projections on adjacent containers. Also, it is often necessary to apply additional pressure to the latch which requires the use of a makeshift tool such as a screwdriver, tire tool, etc. The procedure can and usually does damage the latch, necessitating replacement and/or repair of the latch before the container can be reused.

Another presently available compression latch is one which is especially designed to be used with a tool for applying the closure pressure. Although this system does eliminate the danger of damage to the latch, the required use of a tool, either special or makeshift, is undesirable because a tool must be available or supplied with each container or group of containers. This would necessarily present a logistical problem and detract from the overall effectiveness of the latch when used on a munitions container in the field.

The present invention provides means for avoiding the above-mentioned drawbacks by eliminating the large exposed surfaces which tend to hook on adjacent containers and by eliminating the need for any special or makeshift tools to operate the latch in the field.

SUMMARY OF THE INVENTION

The present invention provides an improved latch for use on an ammunition shipping container or the like and is characterized by using both the overcenter and fulcrum principles to apply closure pressure without the need for tools. The latch opens in the same plane as the wall of the container and the stress is distributed to two attachment points on the wall instead of one. In the closed position, the latch is inside the envelope of the container and the tension is adjustable in either open or closed position by means of an infinite screw adjustment for tension.

Accordingly, it is an object of the invention to provide a quick opening/closing compression latch which is infinitely adjustable to allow application of proper sealing pressure.

Another object of the invention is to provide a latch suitable for use on an ammunition container wherein there is sufficient mechanical advantage to effect a sealing force on the gasket seal without the necessity of auxiliary tools.

Still another object of the invention is to provide a compression latch having a reduced energy requirement for opening and closing operations. This is accomplished by the mechanical advantage acquired through the unique arrangement of the handle and cross bar members.

A further object of the invention is to provide an ammunition container latch which is physically positioned inside the envelope of the container thereby offering a greater degree of durability and reliability in service.

A still further object of the invention is to provide a compression latch for a container including a tab member fixedly attached to the lid thereof. The tab member serves the dual purpose of transferring the compression force to the gasket between the wall of the container and the lid as well as acting as a physical stop between the wall and the lid. This arrangement permits the application of the exact amount of sealing pressure to effect a tight seal while not applying excessive pressure which would cause the seal to take a permanent set after a period of time resulting in leakage.

These and other objects, features and advantages will become more apparent after considering the following description taken in conjunction with the annexed drawings and appended claims.

BRIEF DESCRIPTION OF THE DRAWINGS

FIG. 1 is an expoloded perspective view of the quick opening/closing compression latch according to the invention; and FIG. 2 is a plan view of the latch in the closed position attached to a munitions shipping and storage container.

DESCRIPTION OF A PREFERRED EMBODIMENT

Referring now to the drawings, in FIG. 1, there is shown an exploded perspective drawing of the compression latch according to the invention which is particularly useful for the closure of munitions shipping and storage containers. Likewise, in FIG. 2, there is shown a side elevation of the latch of FIG. 1 in assembled condition attached to a munitions container. In the two views, like reference numerals refer to comparable elements of the latch. The munitions container includes a wall section 13 and a lid 15 with a rubber gasket 17 positioned therebetween. The latch itself includes three primary elements all of which are pivotally connected to the container and/or each other.

A first U-shaped pivot clip 19 is welded or otherwise secured to the top face of the wall section 13. Aligned openings 21 are disposed in the upper portion of the pivot clip 19 for receiving the pin 23. A second U-shaped pivot clip 25 is welded or otherwise secured to the top face of the wall section 13 spaced away from the first clip 19 and aligned therewith. Aligned openings 27 are disposed in the pivot clip 25 for receiving the pin 29. A C-clip 31 with openings through its upper and lower sections is pivotally connected to the pivot clip 25 by means of the pin 29 which passes through the opening in the lower section thereof. The upper section of the C-clip 31 is pivotally attached to a handle 33 by means of a pin 35 which passes through aligned openings 37 therein. The handle 33 is preferably but not necessarily in the form of a stamping and the main body section is U-shaped with the pivot portion having the connecting material removed to form two walls between which the C-clip 31 pivots. The C-clip 31 effectively links the handle 33 to the wall 13 through the pins 35 and 29 and the pivot clip 25.

A cross bar 39 is pivotally connected to the pivot clip 19 by means of the pin 23 which passes through the opening 41 in the pivot end. The other end of the cross bar 39 is provided with an opening 43 through which a pin 45 is passed extending beyond both sidewalls of the cross bar 39. A slot 47 in the handle 33 engages the extending portions of the pin 45 during closure of the latch.

A tab 49 which is welded or otherwise secured to the lid 15 serves a dual role on the latch. First, it serves as a means for transferring the compression force to the gasket 17 between the wall 13 of the container and the lid 15. Second, the tab 49 acts as a physical stop between the wall 13 and the lid 15 thereby controlling the amount of sealing pressure that is applied to the gasket 17. An Allen screw 51 is threadably positioned through a vertically oriented opening 53 in the cross bar 39. By raising and lowering the screw 51, the closure force of the latch can be adjusted which, in turn, controls the amount of sealing pressure applied to the lid 15 of the container.

In operation, to open the latch, the handle 33 is rotated counter-clockwise until the pin 45 is disengaged from the slot 47 which in turn allows the cross bar 39 to rotate clockwise thereby releasing the closure force on the tab 49. The cross bar 39 is rotated clockwise sufficiently to allow the lid 15 to be removed from the container. The technique of closing would be in the reverse order, that is, the handle 33 would be rotated clockwise and the cross bar 39 counter-clockwise. The arrangement of the parts of the invention produces what is commonly known as an over-the-center lock which causes the latch to remain in the closed position until a force is exerted on the handle 33 in a counter-clockwise direction sufficient to overcome the over-center force.

Thus, it can be seen that although the hereinbefore described improved latch is designed primarily for medium-sized shipping and storage containers, it can be employed on all size containers by varying the spacing between latches and the strength of the various latch members. Maximum closing pressure can be varied by the placement of the adjusting screw 51 along the cross bar 39. Also, it should be noted that the tab 49 which acts as a physical stop between the wall 13 and the lid 15 is located at the force transfer point. This feature prevents the deflection of metal in the gasket area which is a common fault in most other presently used latches wherein the deflection causes too much or too little sealing pressure on the gasket depending on where the physical stops are placed.

Although the invention has been illustrated in the accompanying drawings and described in the foregoing specification in terms of a preferred embodiment thereof, the invention is not limited to this embodiment or to the particular configuration mentioned. It will be apparent to those skilled in the art that no special tool is needed to open or close the latch and that, since the latch is physically within the envelope of the container, there is little chance of damage to the latch during shipping.

Having thus set forth and disclosed the nature of my invention, what I claim and desire to secure by Letters Patent of the United States is:

1. In a compression latch positioned within the envelope of an ammunition shipping container including a lid and a walled body portion with a resilient gasket therebetween and operating in the same plane as the wall of the container, the improvement comprising a first U-shaped pivot clip fixedly attached to the wall of said body portion, said first pivot clip having aligned openings for receiving a pin therethrough, a second U-shaped pivot clip fixedly attached to the wall of said body portion in spaced alignment with said first pivot clip, said second pivot clip having aligned openings for receiving a pin therethrough, a C-clip having one end pivotally attached to said first U-shaped pivot clip, a handle having aligned openings in the forward end thereof, the other end of said C-clip being pivotally attached to the forward end of said handle with a pin member through the aligned openings therein, a cross bar having its rearward end pivotally connected to said second U-shaped pivot clip, a pin affixed in the forward end of said cross bar and extending outwardly beyond the walls thereof, a slot in the forward end of said handle for engaging the extending portions of the pin in said cross bar, and a tab fixedly attached to the lid of the container and extending outwardly therefrom into the area between said first and second U-shaped pivot clips whereby clockwise movement of said handle after engagement of the slot therein with the pin in said cross bar causes said cross bar to press against the top of said tab and force the lid against the gasket positioned on the wall of the body portion of the container.

2. The improved compression latch defined in claim 1 wherein said tab fixedly attached to the lid of the container makes contact with the wall of the body portion of the container when said handle is fully rotated in the clockwise direction thereby stopping further compression of the gasket between the lid and the body portion of the container.

3. The improved compression latch defined in claim 1 including means for controlling the amount of sealing pressure applied to the lid of the container.

4. The improved compression latch defined in claim 3 wherein the means for controlling the amount of sealing pressure includes a screw member threadably positioned in a vertically oriented opening in said cross bar, the lower end of said screw member being in contact with the upper surface of said tab when the latch is in the closed position, the raising and lowering of said screw member producing a corresponding decrease and increase in the sealing pressure applied to the lid of the container.

* * * * *